US007686894B2

(12) United States Patent
Okumus et al.

(10) Patent No.: US 7,686,894 B2
(45) **Date of Patent: *Mar. 30, 2010**

(54) MAGNETICALLY SOFT POWDER COMPOSITE MATERIAL, METHOD FOR MANUFACTURING SAME, AND ITS USE

(75) Inventors: Adnan Okumus, Kornwestheim (DE); Waldemar Draxler, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 1348 days.

This patent is subject to a terminal disclaimer.

(21) Appl. No.: 10/515,738

(22) PCT Filed: Jan. 27, 2003

(86) PCT No.: PCT/DE03/00211

§ 371 (c)(1),
(2), (4) Date: Apr. 22, 2005

(87) PCT Pub. No.: WO03/105161

PCT Pub. Date: Dec. 18, 2003

(65) Prior Publication Data

US 2005/0217759 A1 Oct. 6, 2005

(30) Foreign Application Priority Data

Jun. 6, 2002 (DE) ..... 102 25 154

(51) Int. Cl.
*H01F 1/22* (2006.01)

(52) U.S. Cl. ..... 148/104; 148/306; 252/62.55; 252/62.56; 75/232

(58) Field of Classification Search ..... None
See application file for complete search history.

(56) References Cited

U.S. PATENT DOCUMENTS 5,792,570 A * 8/1998 Ishikawa et al. ..... 428/842.3
5,796,018 A * 8/1998 Moyer et al. ..... 75/230
5,982,073 A 11/1999 Beane et al.
2001/0015589 A1 8/2001 Sakagami et al.

FOREIGN PATENT DOCUMENTS

| | | |
|---|---|---|
| DE | 19960095 | 7/2001 |
| DE | 100 31 923 | 1/2002 |
| EP | 0406580 | 1/1991 |
| GB | 805 710 | 12/1958 |
| JP | 1013705 | 1/1989 |
| JP | 3180434 | 8/1991 |
| JP | 4352403 | 12/1992 |
| WO | WO 01/45116 A1 * | 6/2001 |
| WO | WO0145116 | 6/2001 |

OTHER PUBLICATIONS

English Translation of PCT Document No. WO 01/45116 A1 (Draxler '116).*

* cited by examiner

*Primary Examiner*—John P. Sheehan
(74) *Attorney, Agent, or Firm*—Kenyon & Kenyon LLP

(57) ABSTRACT

A magnetically soft powder composite material is described, which is composed of at least 99.4 wt. % of a pure iron powder, a phosphatized iron powder, or an iron alloy powder and 0.05 wt. % to 0.6 wt. % of a soft ferrite powder and which is primarily suited for use in rapidly switching solenoid valves in motor vehicle engines. Furthermore, a method for manufacturing such a magnetically soft powder composite material includes the following method steps:

a) preparation of a starting mixture including a pure iron powder, a phosphatized iron powder, or an iron alloy powder and a soft ferrite powder,
b) mixing of the starting mixture,
c) compacting of the starting mixture in a press under increased pressure,
d) debinding of the compacted starting mixture in an inert gas atmosphere or in an oxygen-containing gas atmosphere, and
e) heat treatment of the compacted starting mixture in an oxidizing gas atmosphere at a temperature of 410° C. to 500° C.

19 Claims, No Drawings

MAGNETICALLY SOFT POWDER COMPOSITE MATERIAL, METHOD FOR MANUFACTURING SAME, AND ITS USE

FIELD OF INVENTION

The present invention relates to a magnetically soft powder composite material, and a method for manufacturing such a material.

BACKGROUND INFORMATION

Modern gasoline engines and diesel engines require increasingly efficient solenoid injectors in order to meet the demands for reducing fuel consumption and pollutants, for example. Rapidly switching solenoid injectors are manufactured using magnetically soft materials, such as FeCr alloys or FeCo alloys, or powder composite materials having an intrinsic electrical resistance as high as possible. However, due to alloy-associated measures, only an intrinsic electrical resistance of 1 μΩm maximum is achievable in metallic materials.

Furthermore, a magnetic material composed of iron powder and an organic bonding agent may be used in valves for diesel injection (common rail system). Although these materials have higher intrinsic electrical resistances than the aforementioned magnetically soft alloy materials, they are limited in many cases with respect to their fuel stability and thermal stability and are also poorly processable.

German Published Patent Application No. 199 60 095 describes a sintered magnetically soft composite material and a method for its manufacture in which a ferromagnetic starting component as the main component and a ferritic starting component as a minor component are used in a starting mixture from which, after a heat treatment, a magnetically soft composite material is formed. After the heat treatment of the starting mixture forming the composite material, the second starting component represents a grain boundary phase. The first starting component is a pure iron powder or a phosphatized iron powder, for example; the second starting component is a ferrite powder, e.g., a soft ferrite powder, such as MnZn ferrite or NiZn ferrite. The proportion of the iron powder in the starting mixture equals 95 percent to 99 percent by weight, and the proportion of the ferrite powder equals 1 percent to 25 percent by weight.

SUMMARY

It is an object of the present invention to provide a magnetically soft powder composite material which has a magnetic saturation polarization and magnetic permeability which are as high as possible combined with an intrinsic electrical resistance which is as high as possible.

The magnetically soft powder composite material may provide that it has a magnetic saturation polarization of more than 1.85 Tesla, e.g., 1.90 Tesla to 2.05 Tesla, and, that it has a clearly elevated intrinsic electrical resistance of more than 1 μΩm, e.g., of 5 μΩm to 15 μΩm. The intrinsic electrical resistance lies at approximately 10 μΩm. In addition, the magnetically soft powder composite material according to the present invention may have a flexural strength of more than 120 mPa, measured from cylindrical samples. The edge fracture strength of the components made of this material in the form of solenoid cups for injectors is over 45 kN, and, in addition, the achieved magnetically soft powder composite material is thermo-stable and fuel-stable at a temperature of up to at least 400° C. Therefore, the material is very well suited for manufacturing rapidly switching solenoid valves of the type required for diesel injection in motor vehicle engines.

The method according to the present invention for manufacturing the magnetically soft powder composite material provides for adding a pressing support arrangement, a micro wax for example, to the starting mixture facilitates pressing and that the properties of the achieved powder composite material may be easily adjusted via the gas atmosphere and the temperature program during debinding or during the heat treatment.

The utilized soft ferrite powder may be an MnZn ferrite powder, an NiZn ferrite powder, or a mixture of both powders. The powder particles of the utilized pure iron powder, the iron alloy powder, or the utilized phosphatized iron powder may have an average grain size of between 30 μm and 150 μm, while, in contrast, the grain size of the utilized soft ferrite powder is clearly smaller and averages less than 20 μm. The average grain size of the utilized soft ferrite powder particles may be less than 5 μm, e.g., less than 1 μm.

DETAILED DESCRIPTION

The manufacture of the magnetically soft powder composite material starts with a starting mixture composed of a pure iron powder or a phosphatized iron powder and a soft ferrite powder. Iron alloy powders, such as FeCr powder or FeCo powder, may also be used as an alternative to the iron powder.

Phosphatized iron powder may be used since it achieves the best electrical properties of the powder composite material.

Furthermore, a pressing support arrangement, such as a micro wax, may also be added to the starting mixture, the pressing support arrangement being removed again during the course of a subsequent heat treatment of the starting mixture for manufacturing the magnetically soft powder composite material. The proportion of the pressing support arrangement in the starting mixture is 0 wt. % to a maximum of 0.8 wt. %. Apart from the pressing support arrangement, the starting mixture is composed of at least 99.4 wt. % of a pure iron powder or a phosphatized iron powder and 0.1 wt. % to 0.6 wt. % of a soft ferrite powder. The proportion of the pure iron powder or the phosphatized iron powder may equal more than 99.5 wt. %, e.g., 99.7 wt. % to 99.8 wt. %. The proportion of the soft ferrite powder may equal less than 0.5 wt. %, e.g., 0.1 wt. % to 0.3 wt. %. Unavoidable contaminations or negligible residues of the initially added pressing support arrangement which are possibly still present have been neglected in this calculation of the composition of the achieved magnetically soft composite material which materializes after the mixing, compressing, debinding, and the heat treatment of the initially created starting mixture.

The utilized soft ferrite powder may be a manganese-zinc ferrite ($MnZnOFe_2O_3$) or a nickel-zinc ferrite ($NiZnOFe_2O_3$), or a mixture of both powders. Phosphatized iron powder or phosphatized pure iron powder and one of these two soft ferrite powders may be used.

The powder particles of the pure iron powder or the phosphatized iron powder have an average grain size of 50 μm to 100 μm. The grain size of the utilized soft ferrite powder may be distinctly below 20 μm, e.g., below 5 μm. It is, for example, in the range between 0.5 μm and 2 μm, e.g., around 1

Moreover, it should be pointed out that, depending on the intended application of the achieved material, during the composition of the starting mixture, which is made up of the pure iron powder or the phosphatized iron powder and the soft ferrite powder, more importance may be attached to a magnetic saturation polarization and magnetic permeability which are as high as possible, i.e., $\mu_{max}$ greater than 800, or to an intrinsic electrical resistance which is as high as possible by varying the composition of the material.

The above-explained powders are first made available in the form of a starting mixture as explained, and then, with the aid of a press, compressed under increased pressure and brought into the intended shape. Debinding of the green compacts produced in this manner is subsequently performed in a furnace in an inert gas atmosphere, a nitrogen atmosphere for example, or an oxygen-containing gas atmosphere. For this purpose, the compressed starting mixture is heated in the furnace to a temperature of 400° C. to 500° C. and kept there for a period of ten minutes to one hour. The temperature during debinding depends primarily on the utilized pressing support arrangement, i.e., the micro wax used. To this end, the temperature may also be below the 400° C. mentioned, in the range of 220° C. to 300° C., for example.

Another heat treatment of the debound, compressed starting mixture occurs after debinding in an oxidizing gas atmosphere in a furnace at a temperature of 410° C. to 500° C. The molding is heated in the furnace to this temperature and is kept there for a period of 20 minutes to 400 minutes, 200 minutes, for example. The gas atmosphere in the furnace is air, for example.

This method yields a magnetically soft powder composite material in which the utilized soft ferrite powder is at least largely present as a grain boundary phase, i.e., the soft ferrite powder particles enclose the iron powder particles used in the powder composite material.

The pressing support arrangement used during the course of the manufacturing method facilitates compacting and shaping of the starting mixture during pressing. However, the pressing support arrangement should be completely removed or evaporated during debinding in such a manner that it does not directly affect the obtainable material characteristic values of the achieved magnetically soft powder composite material. This is primarily achieved by using micro wax as the pressing support arrangement.

Compacting of the starting mixture in the die under increased pressure may be performed by uniaxial pressing at a pressure of 500 mPa to 1000 mPa.

Finally it should be pointed out that solenoid valves manufactured using the magnetically soft powder composite material of the present invention are absolutely fuel-stable and thermo-stable under typical conditions of use in diesel injectors in motor vehicles. In addition, they have a very good mechanical stress capacity with respect to flexural strength as well as edge fracture strength.

What is claimed is:

1. A magnetically soft powder composite material, comprising:

at least 99.4 wt. % of one of a pure iron powder, a phosphatized iron powder, and an iron alloy powder; and 0.05 wt. % to 0.6 wt. % of a soft ferrite powder.

2. The magnetically soft powder composite material of claim 1, wherein the soft ferrite powder includes one of an MnZn ferrite powder, an NiZn ferrite powder, and a mixture of the MnZn ferrite powder and the NiZn ferrite powder.

3. The magnetically soft powder composite material of claim 1, wherein powder particles of one of the pure iron powder and the phosphatized iron powder have an average grain size between 30 μm and 150 μm.

4. The magnetically soft powder composite material of claim 1, wherein powder particles of the soft ferrite powder have an average grain size of less than 20 μm.

5. The magnetically soft powder composite material of claim 4, wherein the average grain size of the powder particles is below 5 μm.

6. The magnetically soft powder composite material of claim 5, wherein the average grain size of the powder particles is below 1 μm.

7. The magnetically soft powder composite material of claim 1, wherein the magnetically soft powder composite material has a saturation polarization of more than 1.85 Tesla.

8. The magnetically soft powder composite material of claim 7, wherein the magnetically soft powder composite material has a saturation polarization of 1.90 Tesla to 2.05 Tesla.

9. The magnetically soft powder composite material of claim 1, wherein the magnetically soft powder composite material has an intrinsic electrical resistance of more than 1 μΩm.

10. The magnetically soft powder composite material of claim 9, wherein the magnetically soft powder composite material has an intrinsic electrical resistance of 5 μΩm to 15 μΩm.

11. A method for manufacturing a magnetically soft powder composite material, comprising:

a) preparing a starting mixture including a soft ferrite powder and one of a pure iron powder, a phosphatized iron powder, and an iron alloy powder;

b) mixing the starting mixture;

c) compacting the starting mixture in a press under increased pressure to form a compacted starting mixture;

d) removing a binder from the compacted mixture in one of an inert gas atmosphere and an oxygen-containing gas atmosphere; and e) heat treating the compacted mixture debinded in d) in an oxidizing gas atmosphere at a temperature of 410° C. to 500° C.

12. The method of claim 11, further comprising:

adding a pressing support arrangement to the starting mixture before the mixing step.

13. The method of claim 12, wherein the pressing support arrangement includes a micro wax.

14. The method of claim 11, wherein the removing is performed at a temperature of 400° C. to 520° C. over a period of ten minutes to one hour.

15. The method of claim 11, wherein the heat treating is performed over a period of 20 minutes to 400 minutes.

16. The method of claim 11, wherein the removing is performed in one of a nitrogen atmosphere, an oxygen-nitrogen mixture, and air over a period of 10 minutes to 70 minutes.

17. The method of claim 16, wherein the oxygen-nitrogen mixture includes 5 vol % to 30 vol % of oxygen.

18. A rapidly switching solenoid valve, comprising: a magnetically soft powder composite material including:

at least 99.4 wt. % of one of a pure iron powder, a phosphatized iron powder, and an iron alloy powder; and 0.05 wt. % to 0.6 wt. % of a soft ferrite powder.

19. The rapidly switching solenoid valve of claim 18, wherein the rapidly switching solenoid valve is a diesel injection valve.

* * * * *